US011268471B1

(12) United States Patent
Hill et al.

(10) Patent No.: US 11,268,471 B1
(45) Date of Patent: Mar. 8, 2022

(54) METHOD AND SYSTEM FOR IDENTIFICATION OF FUEL INJECTOR TYPE

(71) Applicant: Caterpillar Inc., Peoria, IL (US)

(72) Inventors: Adam C. Hill, Pontiac, IL (US); Manjunath B. Nagaraja, Naperville, IL (US); Stephen R. Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/102,484

(22) Filed: Nov. 24, 2020

(51) Int. Cl.

| | |
|---|---|
| ***F02D 41/22*** | (2006.01) |
| ***F02M 65/00*** | (2006.01) |
| ***F02D 41/20*** | (2006.01) |
| ***F02M 51/06*** | (2006.01) |
| *F02D 41/40* | (2006.01) |

(52) U.S. Cl.
CPC ..... *F02D 41/20* (2013.01); *F02D 41/22* (2013.01); *F02D 41/221* (2013.01); *F02M 51/061* (2013.01); *F02M 65/005* (2013.01); *F02D 41/402* (2013.01); *F02D 2041/2003* (2013.01); *F02D 2041/2058* (2013.01); *F02D 2041/224* (2013.01); *F02D 2200/063* (2013.01)

(58) Field of Classification Search
CPC ..... F02D 41/22; F02D 41/221; F02D 2041/2058; F02D 2041/224; F02D 2200/063; F02M 65/005
USPC ..... 73/114.45; 123/479, 490
See application file for complete search history.

(56) References Cited

U.S. PATENT DOCUMENTS

| | | | | |
|---|---|---|---|---|
| 6,651,629 | B2 * | 11/2003 | McCoy | F02D 41/20 123/478 |
| 7,822,537 | B2 | 10/2010 | Perryman et al. | |
| 7,917,310 | B2 | 3/2011 | Pearce et al. | |
| 7,966,871 | B2 | 6/2011 | Perryman et al. | |
| 8,915,126 | B2 | 12/2014 | Friedmann et al. | |
| 8,989,994 | B2 | 3/2015 | Love et al. | |
| 2010/0307457 | A1 * | 12/2010 | Sugiyama | F02D 41/2435 123/478 |
| 2017/0145975 | A1 * | 5/2017 | Majer | G01F 22/02 |
| 2018/0156153 | A1 * | 6/2018 | Denk | F02D 41/20 |
| 2018/0252752 | A1 * | 9/2018 | Shahroudi | F02D 41/2422 |

* cited by examiner

*Primary Examiner* — Erick R Solis
(74) *Attorney, Agent, or Firm* — Bookoff McAndrews PLLC

(57) ABSTRACT

A method for identifying a type of a fuel injector installed in an internal combustion engine includes generating a control signal to supply electrical energy from a power source for actuating the fuel injector, monitoring the electrical energy, identifying a pattern in the electrical energy, the pattern being indicative of the type of the fuel injector, and outputting a notification indicative of an incorrect injector type based on the pattern.

17 Claims, 4 Drawing Sheets

METHOD AND SYSTEM FOR IDENTIFICATION OF FUEL INJECTOR TYPE

TECHNICAL FIELD

The present disclosure relates generally to systems for internal combustion engines, and more particularly, to methods and systems for identifying one or more characteristics of a fuel injector installed in an internal combustion engine.

BACKGROUND

Internal combustion engines involve the interaction of a number of complex components, including parts that are regularly replaced or upgraded. Some engines include electronic control units that have programming to control the operation of one or more components of the engine, such as fuel injectors, based on the design, expected response, or other qualities of the engine component. Some electronic controls unit include programming to modify aspects of fuel injector control based on qualities of the installed injector. These injector qualities can be provided to the electronic control unit by uploading a program to the control unit, or by inputting a predetermined code associated with a particular injector. If an injector with differing features is subsequently installed, the control unit can be provided with new programming associated with this new injector. However, performance issues can arise when an injector is installed without updating the control unit. Performance is also impaired when the control unit is updated incorrectly, for example by providing an incorrect code or program to the control unit. A control unit that is improperly configured can inject a larger or smaller quantity of fuel than intended, which can result in increased emissions of unwanted exhaust components such as smoke. Improper configuration of the control unit can have other adverse effects on the performance of the engine. For example, an improperly configured control unit can result in poor fuel economy, low engine power, rough idle, and increased wear.

A method of identifying a short circuit in a fuel injector is disclosed in U.S. Pat. No. 7,966,871 (the '871 patent) to Perryman et al. The method described in the '871 patent includes determining when current exceeds a set limit. This determination can help identify a short circuit associated with the fuel injector. The method described in the '871 patent also includes comparing monitored voltages to determine whether a voltage is 0 Volts, at a predetermined time, to determine whether a short circuit condition exists. While the method described in the '871 patent can be helpful for identifying a short circuit, it may be unsuitable for identifying a type of fuel injector, and/or for detecting when a controller has not been provided with appropriate programming for an installed fuel injector.

The disclosed method and system may solve one or more of the problems set forth above and/or other problems in the art. The scope of the current disclosure, however, is defined by the attached claims, and not by the ability to solve any specific problem.

SUMMARY

In one aspect, a method for identifying a type of a fuel injector installed in an internal combustion engine may include generating a control signal to supply electrical energy from a power source for actuating the fuel injector, monitoring the electrical energy, identifying a pattern in the electrical energy, the pattern being indicative of the type of the fuel injector, and outputting a notification indicative of an incorrect injector type based on the pattern.

In another aspect, a method for identifying a type of fuel injector installed in an internal combustion engine may include applying electrical energy from a power source to a solenoid of the fuel injector, and monitoring current supplied to a solenoid injector, the current including a chopped current that occurs at least partially during a pull-in phase. The method may also include detecting a pattern in the monitored current, identifying the type of fuel injector based on the detected pattern, and performing a corrective action based on an incorrect injector type based on the type of fuel injector.

In yet another aspect, a fuel injector system may include an internal combustion engine, a current sensor configured to generate a signal indicative of an amount of current present in a circuit associated with a fuel injector, and a controller. The controller may be configured to generate commands for supplying electrical energy to a solenoid coil of the fuel injector, receive the signal generated by the current sensor, and identify a type of the fuel injector based on a pattern included in the signal received from the current sensor. The controller may also be configured to generate a notification, control the internal combustion engine, or both, based on an identification of an incorrect injector type.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
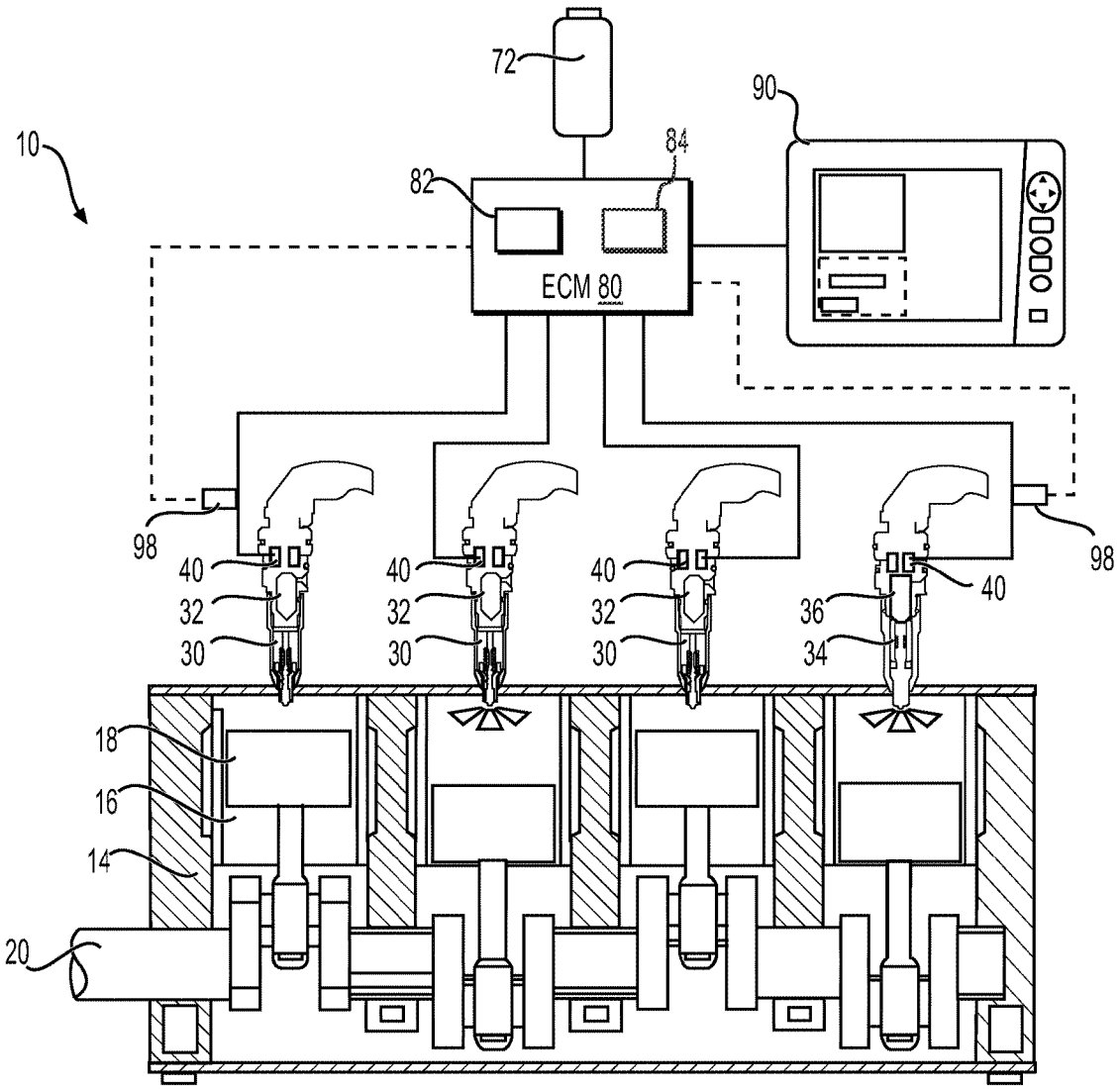
FIG. 1 is a partially schematic cross-sectional view in a fuel injection system, according to aspects of the present disclosure.

FIG. 1 illustrates an exemplary fuel injector identification and control system 10 according to an aspect of the present disclosure. Fuel injector system 10 may include an internal combustion engine 14, a plurality of first and second fuel injectors 30 and 34, a controller in communication with fuel injectors 30 and 34, such as an electronic control module (ECM) 80, and a notification device 90. As will be explained in more detail below, fuel injectors 30 and 34 may be the same type of fuel injectors, or may be different types of fuel injectors, such as when a fuel injector is replaced during maintenance with an incorrect type of fuel injector. As used herein a "type" of fuel injector refers to a fuel injector associated with certain programming that allows the injector to function in a desired manner. When a fuel injector of one type is used in conjunction with programming for a different type of injector, the injector may inject fuel in a manner that adversely affects engine performance. Engine 14 may be an internal combustion engine including a plurality of cylinders 16, a series of pistons 18 positioned within each cylinder 16, and a crankshaft 20. One or more fuel injectors 30 or 34 may be secured to engine 14 to inject fuel (e.g., liquid fuel, such as diesel fuel, or gaseous fuel) toward a respective combustion chamber of cylinders 16. While four cylinders 16 are shown in FIG. 1, engine 14 may include any number of cylinders 16, such as six, eight, ten, twelve, sixteen, twenty or more.

The plurality of fuel injectors may include one or more first fuel injectors 30 and/or one or more second fuel injectors 34. Fuel injectors 30 and 34 may be electronically-controlled injectors that include a solenoid actuation mechanism which includes one or more solenoid coils 40. Each solenoid actuation mechanism, including coils 40, may be associated with a respective control valve to facilitate the injection of predetermined quantities of fuel. Fuel injectors 30 and 34 may receive fuel from a fuel source, such as a common fuel rail, or may be configured as unit injectors. Injectors 30 and 34 may inject fuel in response to control signals generated by ECM 80 to energize the solenoid actuation mechanism. For example, first fuel injectors 30 may include a first control valve 32 configured to facilitate the injection of fuel when solenoid coils 40 are energized. In the instance where the second fuel injector 34 is of a different type than the first fuel injectors 30, second fuel injector 34 may be operable to inject fuel when second fuel injector 34 is installed in an engine 14 with an ECM 80 programmed for first fuel injectors 30, a condition referred to herein as a "mismatch" between ECM 80 and fuel injector 34. A mismatch may also occur when one or more first fuel injectors 30 are installed in an engine 14 with an ECM 80 programmed for second fuel injectors 34.

As noted above, first fuel injectors 30 may be of a different type, i.e., have different operational or performance characteristics, as compared to second fuel injectors 34. For example, first fuel injectors 30 and second fuel injectors 34 may include respective control valves 32 and 36 that perform differently when exposed to the same control inputs. Thus, when a mismatch condition is present, the installed fuel injector (e.g., one or more first fuel injectors 30 or one or more second fuel injectors 34) may respond in an unintended manner. Valves 32 and 36 may respond differently, and inject different quantities of fuel, when the same amount of energy is supplied to solenoid coils 40, for example. These different responses may be related to design differences responsible for improved performance of second fuel injectors 34 (e.g., improved longevity, responsiveness, and/or efficiency) as compared to first fuel injectors 30. Despite differences in performance, first and second fuel injectors 30 and 34 may have the same or similar external shapes, mechanical connections, electrical connections for wiring harnesses, or other shared qualities. These similarities may permit or allow the replacement of one or more first fuel injectors 30 with a second fuel injector 34 without the need to perform significant modifications to other components of engine 14.

A power source of system 10 may be configured to supply electrical energy to components of internal combustion engine 14 and to ECM 80. This power source may include one or more batteries 72 that supply a battery voltage to ECM 80, injectors 30 and 34, and other components of system 10. Battery 72 may be electrically connected to one or more boosting circuits, such as exemplary boosting circuit 82 of ECM 80, for outputting an elevated voltage and thereby boosting current supplied to components of system 10, such as solenoid coils 40, as described below. Battery 72 may be electrically connected to one or more drive circuits 84 that are configured to supply electrical energy to solenoid coils 40 in response to control signals generated by ECM 80. Drive circuit 84 may be configured to supply electrical energy from battery 72 to actuate fuel injectors 30 and 34. ECM 80 may be in communication with a plurality of sensors (e.g., current sensors) 98 that are configured to detect an amount of energy supplied to solenoid coils 40. Sensors 98 may monitor current supplied to coils 40 of each injector and generate a signal indicative of this current to ECM 80. While only two sensors 98 are depicted in FIG. 1, it is understood that sensors 98 may be provided for each respective fuel injector 30 and 34 to allow ECM 80 to monitor each individual injector installed in engine 14 and to identify at least one characteristics of each of these fuel injectors.

ECM 80 may include a single microprocessor or multiple microprocessors configured to receive sensed inputs and generate commands to control the operation of fuel injectors 30 and 34. For example, ECM 80 may control the application of electrical energy to solenoid coils 40 to achieve a desired current through coils 40 (e.g., by controlling a quantity and timing of voltage applied to coils 40 with the use of drive circuitry 84, boosting circuitry 82, etc.). ECM 80 may be configured to control the application of electrical energy to solenoid actuators, including solenoid coil 40. For example, ECM 80 may issue commands to drive circuitry 84 to selectively energize solenoids 40 with electrical power and may control associated circuitry to de-energize solenoids 40.

Figure 3:
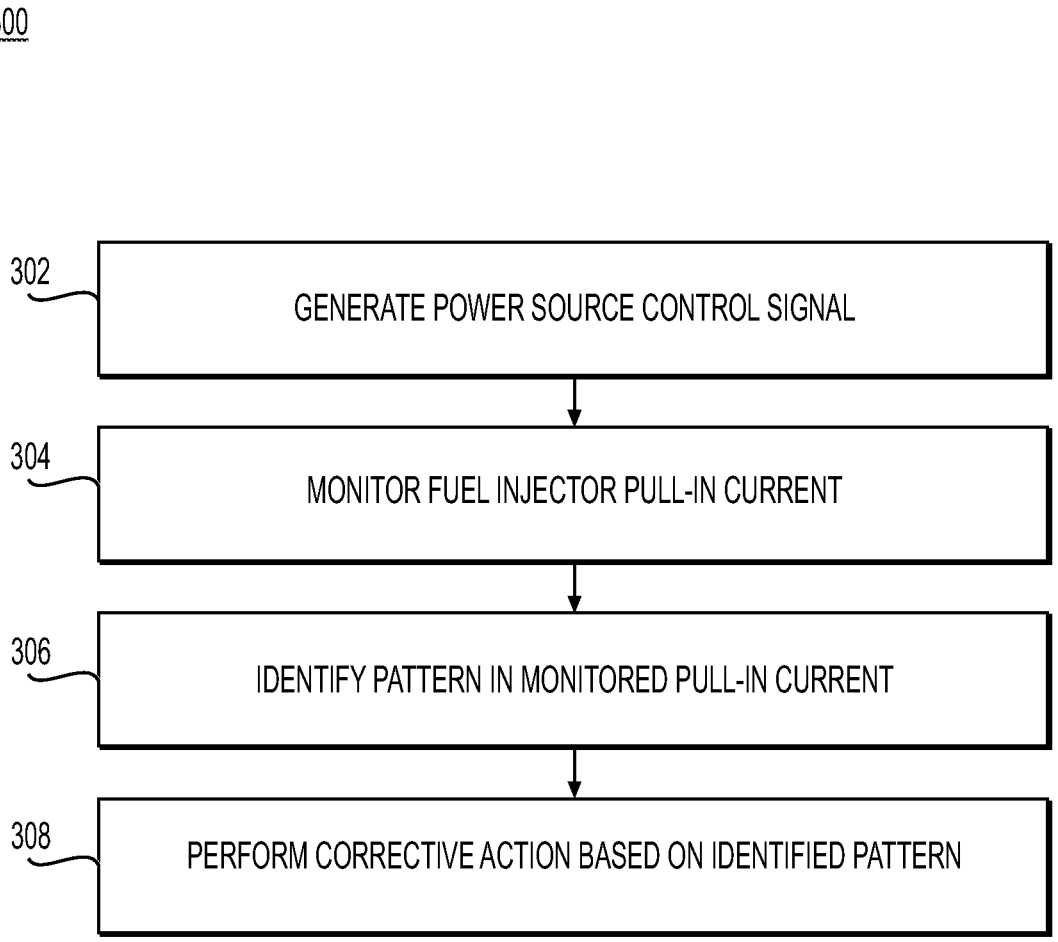
FIG. 3 is a flowchart of a method for identifying characteristics of a fuel injector of an engine system, according to aspects of the present disclosure.

ECM 80 may include a memory, a secondary storage device, processor(s), such as central processing unit(s), networking interfaces, or any other means for accomplishing a task consistent with the present disclosure. The memory or secondary storage device associated with ECM 80 may store data and software to allow ECM 80 to perform its functions, including the functions described below with respect to method 300 (FIG. 3). In particular, data and software in memory or secondary storage device(s) may allow ECM 80 to perform any of the signal analysis, injector characteristic identification, engine derating, and notification functions described herein. Numerous commercially available microprocessors can be configured to perform the functions of ECM 80. Various other known circuits may be associated with ECM 80, including signal-conditioning circuitry, communication circuitry, and other appropriate circuitry.

Notification device 90 may include one or more devices or systems associated with internal combustion engine 14. For example, notification device 90 may include a display or notification area within a cabin of a machine that is driven by engine 14. Additionally or alternatively, notification device 90 may correspond to a screen of a device in communication with ECM 80, such as a diagnostic device, a computing system, or a remote monitoring system. Notification device 90 may be in communication with ECM 80 over a wired or wireless network, such as the Internet, a Local Area Network, WiFi, Bluetooth, or any combination of suitable networking arrangements and protocols. Whether integrated into a machine with ECM 80 or incorporated in one or more remote systems, notification device 90 may include a display or screen configured to present a notification indicative of one or more characteristics of injectors 30 and/or 34, as described below.

Figure 2:
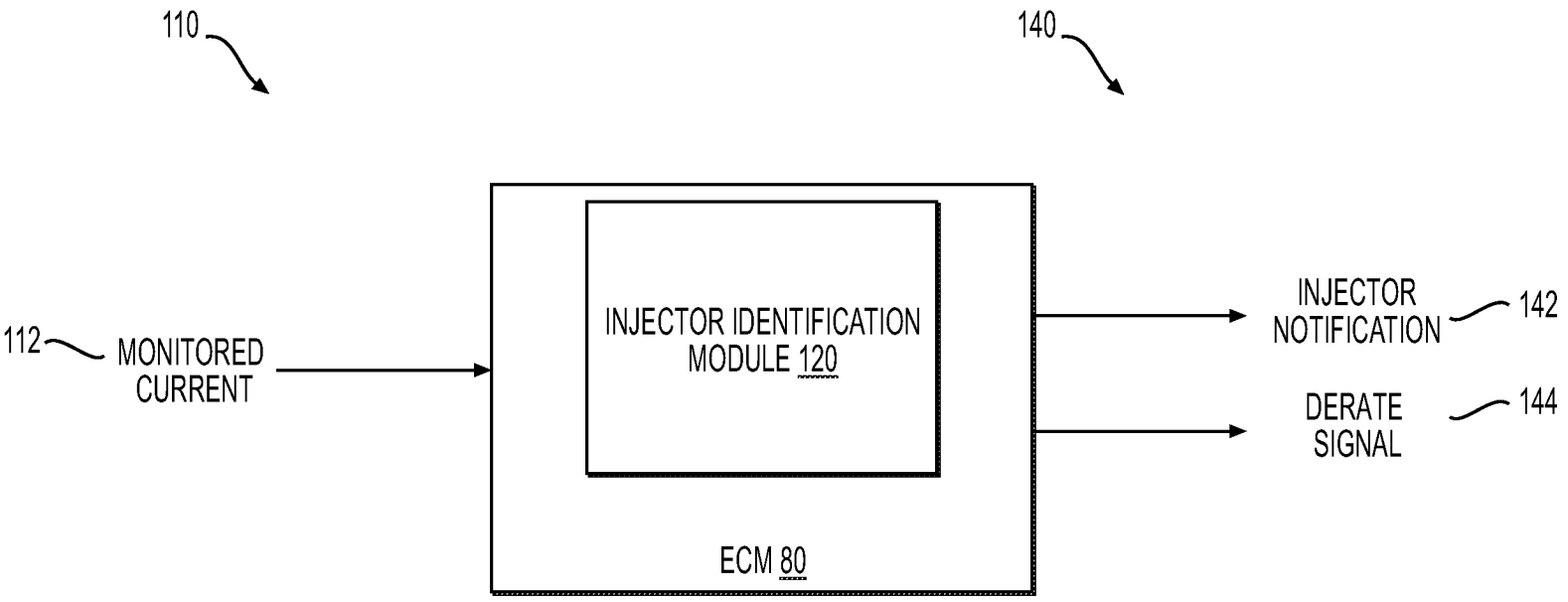
FIG. 2 is a block diagram of an exemplary engine control module of the fuel injection system of FIG. 1.

FIG. 2 illustrates an exemplary configuration of ECM 80 useful for identifying at least one characteristic of fuel injectors 30 and/or 34, and for taking one or more corrective actions based on the identified characteristics. In particular, ECM 80 may be configured to identify a type of fuel injector, and to take a corrective action in response to a determination that an injector type has been installed without configuring ECM 80 for the installed injector(s).

ECM 80 may receive one or more inputs 110, including monitored current 112. Monitored current 112 may be indicative of an amount of current supplied to solenoid coils 40 of each injector of engine 14. Monitored current 112 may correspond to signals generated by sensors 98 (FIG. 1), and may be received as a plurality of monitored current signals, each signal corresponding to a particular injector to allow ECM 80 to associate a particular current waveform with an injector at a specific location of engine 14. ECM 80 may receive additional inputs 110 useful for monitoring and controlling engine 14. For example, ECM 80 may receive information from engine speed sensors, temperature sensors, acceleration sensors, airflow sensors, fuel rate sensors, and pedal position sensors, among others.

ECM 80 may include one or more modules to facilitate the identification of characteristics of injectors 30 and/or 34. For example, ECM 80 may include an injector identification module 120. Injector identification module 120 may include data that enables the identification of characteristics of injectors 30 and/or 34 based on one or more patterns in monitored current 112. For example, injector identification module 120 may be configured to facilitate the detection of the presence of a second injector 34 including a second control valve 36, based on monitored current 112. Injector identification module 120 may facilitate the detection of an injector mismatch by detecting a pattern present in monitored current 112. Patterns included in monitored current 112 may be evaluated for the presence of a frequency, as described below. This frequency may be compared to one or more predetermined frequencies, or frequency ranges, each of which is unique to a different type of injector. For example, when the pattern present in current 112 falls within a predetermined range of frequencies, ECM 80 may be configured to identify the injector associated with this current as being a second injector 34.

ECM 80 may be configured to generate outputs 140, including outputs for controlling components of internal combustion engine 14. This control may be based at least in part on one or more characteristics of fuel injectors 30 and 34 identified based on monitored current 112. In some aspects, ECM 80 may be configured to output one or more notifications and/or perform control of engine 14 based on the identification of injectors 30 or 34. Outputs 140 may correspond to corrective actions taken by ECM 80 based on an identified pattern in monitored current 112. As a first exemplary output 140, ECM 80 may generate an injector notification 142. Injector notification 142 may be transmitted to notification device 90 (FIG. 1), such as a display within a cabin of a machine, a display of a computing device in communication with ECM 80, a mobile device of an operator, supervisor, fleet manager, service center, or other entity that monitors the operation of a machine including engine 14, etc. Injector notification 142 may correspond to one or more diagnostic codes (e.g., on-board diagnostic codes) generated for diagnosing engine 14, and may identify one or more particular injector types, as well as the location of injector responsible for the diagnostic code. ECM 80 may also generate, as an output, a derate signal 144 that limits aspects of the performance of engine 14. For example, derate signal 144 may correspond to command signals that prevent engine 14 from operating above a predetermined engine speed and/or a predetermined load or power. Additionally or alternatively, de-rate signal 246 may include restricting an injection strategy for one or more fuel injectors. For example, de-rate signal 246 may correspond to commands issued to one or more fuel injectors 30 and/or 34 to restrict an injection strategy for one or more cylinders 16. This limitation may restrict an injection strategy to a single main injection for each combustion cycle, and prevent pilot and post injections (e.g., smaller injections that respectively occur immediately prior to or immediately following a main injection).

INDUSTRIAL APPLICABILITY

Fuel injector identification and control system 10 may be used in conjunction with any appropriate machine, vehicle, or other device or system that includes an internal combustion engine having one or more fuel injectors. Fuel injector system 10 may be applied to internal combustion engines in which fuel is injected by one or more electronically-controlled valves, and in particular, solenoid-actuated valves. Fuel injector system 10 may be applied in a variety of machines or vehicles, including machines applicable for earthmoving, paving, power generation, mining, marine applications, transportation, or others. Fuel injector system 10 may be of particular use in systems having replaceable fuel injectors.

In some engine systems, it may be desirable to replace one or more worn or damaged fuel injectors, or replace or upgrade fuel injectors with fuel injectors having different operating characteristics. For example, it may be desirable to replace a series of previously-installed fuel injectors with a respective series of fuel injectors having a modified design. The replacement fuel injectors may offer improved performance, including improved responsiveness, improved control over fuel injection quantities, increased longevity, and/or other benefits. Once a new or replacement injector is installed, it may be desirable to provide ECM 80 with suitable programming for the new injector, or otherwise prepare ECM 80 for operation with the new injector. With reference to method 300 described below, in order to prevent a continuing mismatch between the new injector(s) and this programming, it may be desirable to use a control unit to identify one or more characteristics of a newly-installed or replacement fuel injector. For example, system 10 may include an ECM 80 that acts as a safeguard to ensure that an operator provides ECM 80 with the programming associated with this fuel injector 34.

FIG. 3 is a flowchart illustrating an exemplary method 300 for identifying one or more characteristics of a fuel injector installed in engine 14. Method 300 may be performed during normal operation of engine 14. However, if desired, method 300 may be performed at startup or at predetermined intervals. A step 302 of method 300 may include generating a power source control signal. This may include controlling one or more drive circuits 84 of ECM 80 to apply electrical energy to solenoid coils 40. Step 302 may also include boosting the energy applied to solenoid coils 40 with boosting circuitry 82, and thereby boosting the current supplied to solenoid coils 40. During a step 304, ECM 80 may monitor current applied to solenoid coils 40, via sensors 98 provided for respective injectors 30 and 34. In particular, step 304 may include monitoring pull-in current applied to actuate the fuel injectors with ECM 80.

Figure 4:
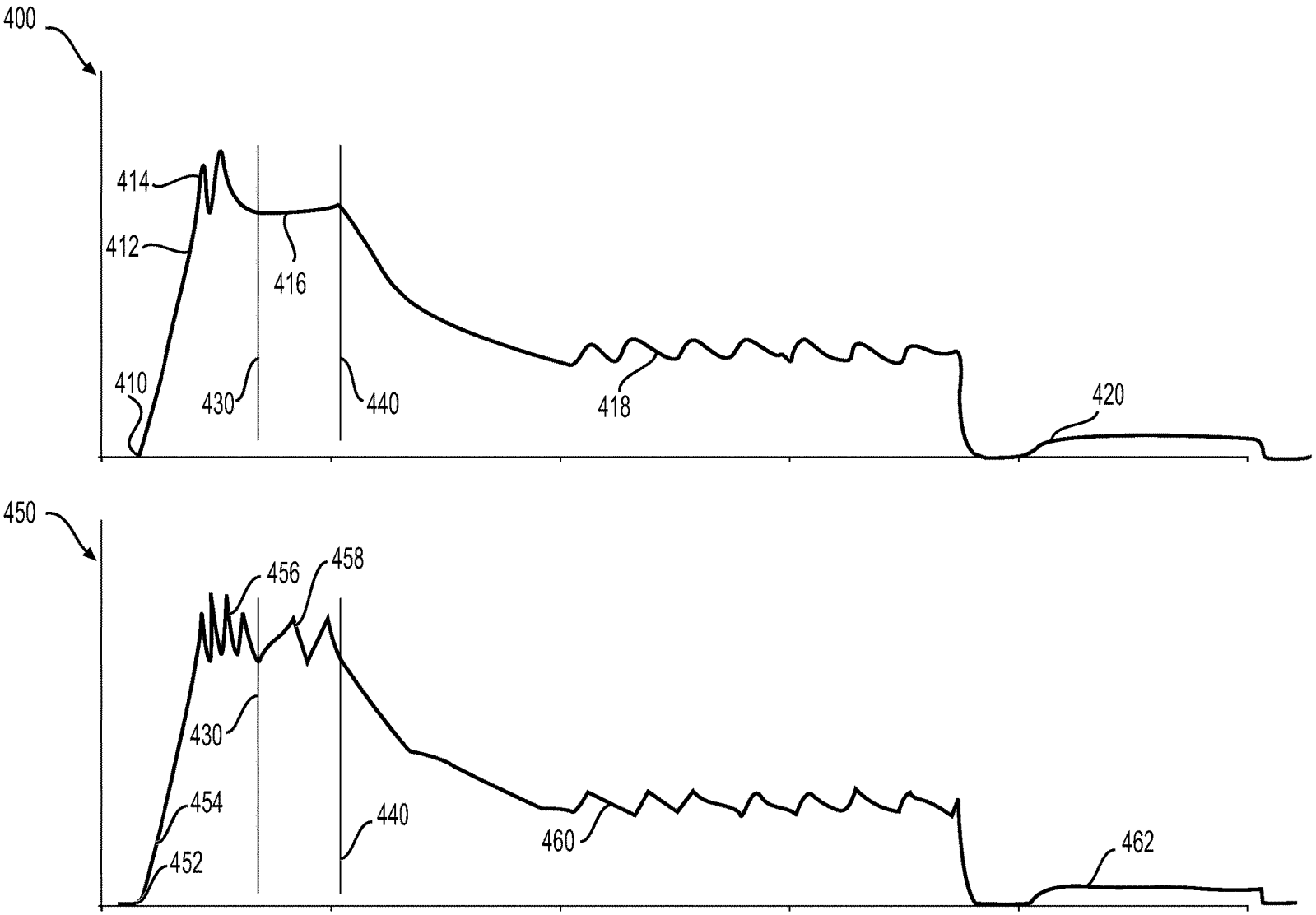
FIG. 4 is a chart illustrating an exemplary operation of the fuel injection system of FIG. 1.

FIG. 4 illustrates exemplary waveforms that are generated in step 302 and monitored in step 304. Waveform 400 may correspond to detected current that is supplied to an injector controlled by ECM 80. In particular, waveform 400 may correspond to an injector type (e.g., first injector 30) for which ECM 80 has been provided with matching control programming. When energy is first supplied to this injector 30, an initial current 410 may begin increasing. This initial current 410 may transition to a rapid current ramp up 412 due to a boosted voltage (e.g., a voltage greater than the voltage of battery 72) applied by boosting circuit 82. Following current ramp up 412, the boosted current may begin to be chopped or limited by cycling the application of boosted energy so as to form a chopped pull-in current 414. At a predetermined time at or near time 430, boosting circuit 82 may stop increasing the voltage of energy applied to solenoid coils 40, causing a voltage substantially equivalent to the voltage of battery 72 to be applied via drive circuitry 84. This may result in a battery pull-in current 416 that is free of chopping. Battery pull-in current 416 may be monitored for the presence of chopping during a predetermined window of time extending between times 430 and 440, as described below. Following the application of battery pull-in current 416, ECM 80 may allow current to naturally decay until a hold-in current 418 is applied, as a chopped current, for a period of time determined by ECM 80. Following the application of hold-in current 418, a return motion associated with valve 32 may occur while ECM 80 detects a free-wheeling current 420.

Waveform 450 may correspond to detected current applied to a second injector 34 that is mismatched with ECM 80 (e.g., ECM 80 does not include programming designed for controlling this injector type). For example, a waveform similar to waveform 450 may be generated when ECM 80 is programmed to control first injectors 30, but is actually controlling one or more second injectors 34. Waveform 450 may correspond to current that is provided to solenoid coils 40 of a second injector 34 in response to power source control signals generated in step 302, as well as to current monitored in step 304.

Similar to waveform 400, waveform 450 may include an initial current 452 that transitions to a rapid ramp up 454 due to the application of boosted electrical energy. The current may transition to a chopped current 456 having a first frequency. The frequency of chopped current 456 may correspond to the amount of time that elapses between current maxima (current peaks) and/or current minima (current valleys) during chopped current 456. At time 430, boosting circuit 82 may stop boosting the voltage of energy applied to solenoid coil 40. Thus, the energy applied following time 430 may correspond to the voltage of battery 72. This energy may result in a battery current 458 being supplied to solenoid coil 40. Chopped current 456 and battery current 458 may each form pull-in current that is supplied at least partially before second valve 36 reaches a fully actuated position. In some aspects, valve 36 may reach a fully actuated position while battery current 458 is being supplied. In other aspects, second valve 36 may reach the fully actuated position after time 440.

As can be seen in FIG. 4, battery current 458 may increase prior to reaching a local maximum value. Upon reaching this local maximum value, energy from battery 72 may be discontinued, by ECM 80, until a local minimum current value is reached. Thereafter, upon reapplication of electrical energy from battery 72, battery current 458 again increases until another local maximum value is reached. This may continue until a predetermined time, such as time 440. The repeating pattern maxima and/or minima of battery current 458 may produce a second frequency that is different (e.g., more frequent or higher) as compared to the first frequency associated with chopped current 456. Following time 440, ECM 80 may cause the current to decrease until hold-in current 460 is supplied. If desired, a free-wheeling current 462 may also be monitored by ECM 80.

A step 306 (FIG. 3) may include identifying a pattern in the current monitored in step 304. For example, ECM 80 may analyze a current waveform during a predetermined period of time, also referred to herein as an analysis window. This analysis window may be correlated with one or more parts of the injection process. For example, the analysis window may extend from a time when unboosted battery voltage is applied during a pull-in phase (e.g., time 430) to a time when the battery voltage is no longer applied (e.g., time 440). The analysis window may include a period of time before the injector valve reaches a fully actuated position. While FIG. 4 illustrates an analysis window that extends for the entire time during which battery current 458 is supplied to solenoid coils 40, the analysis window may instead extend for a portion of this time.

As described above, battery current 458 may be chopped when a second injector 34 is installed without providing appropriate programming to ECM 80. Second injector 34 may experience more rapid current increases when battery voltage is applied, resulting in the above-described chopped battery current 458, due to differences in resistance and/or inductance of circuitry for actuating valve 36. These differences may be due to injectors 30 and 34 having different materials used to construct the solenoid valves, different numbers of turns in coils 40, different air gap sizes, and/or different armatures for actuating valves 32 and 36. ECM 80 may detect when a current limit associated with battery current 458 are reached, and may discontinue the application of electrical energy in response to reaching this limit, resulting in a chopped current that occurs without performing boosting.

ECM 80 may monitor and analyze current for one or more patterns associated with chopped current during an analysis window. In response to the identification of a pattern indicative of chopped current during pull-in, and in particular, during the application of battery voltage 458 during pull-in, ECM 80 may generate a notification or take other corrective action in step 308, as described below. The pattern may be, for example, the detection of one local maximum or a plurality of local maxima. If desired, the pattern may correspond to at least one local maximum, and at least one local minimum at which battery voltage is reapplied to produce an increase in battery current 458. In this manner, ECM 80 may be configured to determine whether chopping occurs while battery voltage is applied to a solenoid coil 40 of each injector.

If desired, step 306 may include analyzing a frequency of the chopped current that occurs during the analysis window. For example, ECM 80 may calculate a frequency of chopped current based on a number of current maxima, a number of current minima, or both, during a particular period of time. This calculated frequency may be employed to identify the type (e.g., model) of fuel injector installed in a particular location (e.g., cylinder) of engine 14. For example, ECM 80 may retrieve one or more stored frequencies associated with respective injector types from injector identification module 120. This may be performed, for example, by querying a map associated with injector identification module 120 to determine a range of frequencies within which the calculated frequency belongs. Each range of frequencies may be associated with a particular injector type. In the example shown in FIG. 4, the frequency of battery voltage 458 may correspond to a frequency within a predetermined range that is associated with a second injector 34 having a second valve 36. ECM 80 may be configured to determine that waveform 400 corresponds to a different injector (e.g., first injector 30), as waveform 400, and in particular battery pull-in current 416, lacks a measurable frequency of maxima and/or minima.

Step 308 may include taking a corrective action based on the pattern identified in step 306. Step 308 may include, for example, derating engine 14 based on the detection of a mismatch between one or more injectors and ECM 80 (e.g., the detection of injector 30 in an ECM 80 configured for injectors 34, or the detection of injector 34 in an ECM 80 configured for injectors 30). A mismatch may be determined, for example, based on the presence of chopped current within a predetermined analysis window that occurs during a pull-in phase. If desired, a detected frequency of the chopped current may be compared to one or more ranges, or compared to a threshold frequency value which, if exceeded, is indicative of a mismatch. Step 308 may further include displaying a suitable notification on a notification device 90, including a display of a machine, an engine code output by ECM 80, and/or a notification provided to a remote device.

In at least some configurations, the corrective action performed in step 308 may include presenting a notification on notification device 90 based on a characteristic of fuel injector that is identified by analyzing the pull-in current pattern. This notification may indicate that improper programming is present on a controller (e.g., ECM 80) of system 10 that performs control of the identified injector. This notification may indicate that one or more second injectors 34 were installed in engine 14 without flashing or otherwise updating the programming of this controller. The notification may also indicate the location of engine 14 at which the second injector 34 is installed. ECM 80 may be configured to identify and display one or more characteristics of an injector (e.g., injector 34), including an identity or type of injector, a behavior of the injector (e.g., increased responsiveness to a particular voltage), or other characteristics that may be indicative of mismatch. In some aspects, step 308 may include derating engine 14 when ECM 80 identifies the presence of a type of injector, such as a second injector 34, that results in a mismatch with the programming of ECM 80. As noted above, a mismatch may also be determined to exist when a first injector 30 is detected by an ECM 80 that is programmed for use with second injectors 34. Step 308 may include both derating engine 14 and presenting a notification via notification device 90 based on the identified characteristic(s).

While the above-described system and method may be useful for identification of characteristics of two different types of injectors, aspects of this disclosure may also facilitate the identification of a larger number of characteristics and injector types. For example, by use of three, four, or more patterns or frequencies, it may be possible to identify an increased number of injectors.

In some engine systems, it may be desirable to replace or upgrade fuel injectors during the life of the engine. When one or more injectors are replaced with such upgrade fuel injector types, control software should be updated to ensure the waveforms for controlling the new injector type achieve the desired behavior. Without this updated control firmware or programming, the engine system can inject a larger or smaller quantity of fuel than intended, which can result in increased emissions of unwanted exhaust components, such as smoke, or even engine damage. Analysis of signals indicative of an amount of energy supplied to each fuel injector may enable identification of characteristics of the new injectors (e.g., old type or new type). Based on this identification, one or more remedial actions may be taken if a mismatch is detected between the programming and the injector type. For example, if a mismatch is detected, it may be possible to provide this information to an operator and/or limit the operation of the engine in a manner that prevents over-fueling or engine damage. For example, a derate mode may be entered to avoid unstable performance or engine damage. Additionally or alternatively, a notification may be provided to prompt an operator to update controller programming or install a correct injector. Thus, it may be possible to differentiate between different injector types or designs in an automated manner by analyzing a signal provided during a pull-in phase for the injector.

It will be apparent to those skilled in the art that various modifications and variations can be made to the disclosed method and system without departing from the scope of the disclosure. Other embodiments of the method and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A method for identifying a type of a fuel injector installed in an internal combustion engine, the method comprising:

generating a control signal to supply electrical energy from a power source for actuating the fuel injector;

monitoring the electrical energy;

identifying a pattern in the electrical energy, the pattern being indicative of the type of the fuel injector; and outputting a notification indicative of an incorrect injector type based on the pattern, wherein the pattern is indicative of a frequency of local maxima, a frequency of local minima, or a frequency of both local maxima and local minima.

2. The method of claim 1, wherein the monitored electrical energy includes a pull-in current applied at a timing at least partially before the fuel injector reaches an actuated position.

3. The method of claim 2, wherein the pattern is indicative of a chopped current that occurs while a battery-level voltage is applied to a solenoid coil of the fuel injector.

4. The method of claim 1, wherein the notification indicates that a control unit associated with the fuel injector is improperly configured for the fuel injector.

5. The method of claim 1, wherein a local maximum of the electrical energy occurs during a pull-in phase of the fuel injector during which a battery current is supplied to the fuel injector without boosting the battery current supplied to the fuel injector.

6. The method of claim 1, further including derating an operation of an internal combustion engine based on the pattern.

7. A method for identifying a type of fuel injector installed in an internal combustion engine, the method comprising:

applying electrical energy from a power source to a solenoid of the fuel injector;

monitoring current supplied to a solenoid injector, the current including a chopped current that occurs at least partially during a pull-in phase;

detecting a pattern in the monitored current;

identifying the type of fuel injector based on the detected pattern; and performing a corrective action based on an incorrect injector type based on the type of fuel injector.

8. The method of claim 7, wherein the corrective action includes limiting an operation of the internal combustion engine.

9. The method of claim 7, wherein the corrective action includes causing a notification to be generated on a display.

10. The method of claim 7, wherein the power source includes a battery.

11. The method of claim 10, wherein the chopped current occurs following an application of a voltage that is higher than a voltage of the battery, during the pull-in phase.

12. A fuel injector system comprising:

an internal combustion engine;

a current sensor configured to generate a signal indicative of an amount of current present in a circuit associated with a fuel injector; and a controller configured to:

generate commands for supplying electrical energy to a solenoid coil of the fuel injector;

receive the signal generated by the current sensor;

identify a type of the fuel injector based on a pattern included in the signal received from the current sensor; and generate a notification, control the internal combustion engine, or both, based on an identification of an incorrect injector type, wherein the pattern is indicative of a chopped current that occurs at least partially during a pull-in phase of the fuel injector.

13. The fuel injector system of claim 12, wherein the controller is configured to generate the notification, the notification being indicative of a mismatch between the fuel injector and the controller.

14. The fuel injector system of claim 13, wherein the notification is indicative of a location of the fuel injector.

15. The fuel injector system of claim 12, wherein the controller is configured to control the internal combustion engine based on the identification of the incorrect injector type by decreasing a maximum permitted speed of the internal combustion engine.

16. The fuel injector system of claim 12, wherein the chopped current occurs while a battery-level voltage is applied to a solenoid coil of the fuel injector.

17. The fuel injector system of claim 16, wherein the chopped current occurs at least partially before the fuel injector reaches an actuated position.

* * * * *